US011021922B2

(12) United States Patent
Jelden

(10) Patent No.: US 11,021,922 B2
(45) Date of Patent: Jun. 1, 2021

(54) LOCKING COLLAR STOP

(71) Applicant: PCS FERGUSON, INC., Frederick, CO (US)

(72) Inventor: Kolten P. Jelden, Greeley, CO (US)

(73) Assignee: PCS Ferguson, Inc., Frederick, CO (US)

( * ) Notice: Subject to any disclaimer, the term of this patent is extended or adjusted under 35 U.S.C. 154(b) by 0 days.

(21) Appl. No.: 16/571,932

(22) Filed: Sep. 16, 2019

(65) Prior Publication Data

US 2021/0079746 A1 Mar. 18, 2021

(51) Int. Cl.

| | |
|---|---|
| ***E21B 23/02*** | (2006.01) |
| ***E21B 23/03*** | (2006.01) |
| ***E21B 23/00*** | (2006.01) |
| ***E21B 23/04*** | (2006.01) |
| ***E21B 23/01*** | (2006.01) |
| ***E21B 43/00*** | (2006.01) |
| ***E21B 23/06*** | (2006.01) |

(52) U.S. Cl.

CPC ..... *E21B 23/02* (2013.01); *E21B 23/00* (2013.01); *E21B 23/01* (2013.01); *E21B 23/03* (2013.01); *E21B 23/0418* (2020.05); *E21B 23/06* (2013.01); *E21B 43/00* (2013.01)

(58) Field of Classification Search

CPC ..... E21B 43/00; E21B 23/00; E21B 23/01; E21B 23/02; E21B 23/03; E21B 23/06; E21B 23/0418

See application file for complete search history.

(56) References Cited

U.S. PATENT DOCUMENTS

| | | | | |
|---|---|---|---|---|
| 2,246,811 A * | 6/1941 | Otis | ..... | E21B 43/122 417/109 |
| 7,080,691 B1 * | 7/2006 | Kegin | ..... | E21B 43/121 166/105 |
| 2010/0252278 A1 * | 10/2010 | Harris | ..... | E21B 23/01 166/382 |

* cited by examiner

*Primary Examiner* — Tara Schimpf
*Assistant Examiner* — Manuel C Portocarrero
(74) *Attorney, Agent, or Firm* — Snell & Wilmer L.L.P.; Russell T. Manning

(57) ABSTRACT

Disclosed herein is a collar stop configured for insertion into well production tubing where the collar stop provides an interference fit with a collar recess disposed between two adjacent sections of production tubing. The collar stop may be utilized to provide a bottom hole assembly at a desired location in a well bore. The collar stop device is configured to lock once positioned. Such locking prevents accidental removal during high fluid flows.

15 Claims, 11 Drawing Sheets

LOCKING COLLAR STOP

FIELD OF THE INVENTION

The present application generally relates to a plunger lift systems used to produce hydrocarbon wells. More specifically, a locking collar stop is provided that may define a bottom of a plunger well where a seating nipple is not utilized.

BACKGROUND

Well bores of oil and gas wells extend from the surface to permeable subterranean formations ('reservoirs') containing hydrocarbons. These well bores are drilled in the ground to a desired depth and may include horizontal sections as well as vertical sections. In any arrangement, piping (e.g., steel), known as casing, is inserted into the well bore. The casing may have differing diameters at different intervals within the well bore and these various intervals of casing may be cemented in-place. Other portions (e.g., within producing formations) may not be cemented in place and/or include perforations to allow hydrocarbons to enter into the casing. Alternatively, the casing may not extend into the production formation (e.g., open-hole completion).

Disposed within a well casing is a string of production piping/tubing, which has a diameter that is less than the diameter of the well casing. The production tubing may be secured within the well casing via one or more packers, which may provide a seal between the outside of the production piping and the inside of the well casing. The production tubing provides a continuous bore from the production zone to the wellhead through which oil and gas can be produced.

The flow of fluids, from the reservoir(s) to the surface, may be facilitated by the accumulated energy within the reservoir itself, that is, without reliance on an external energy source. In such an arrangement, the well is said to be flowing naturally. When an external source of energy is required to flow fluids to the surface the well is said to produce by a means of artificial lifting. One means of artificial lift is plunger lift. A plunger lift system utilizes gas present within the well as a system driver. A plunger lift system works by cycling a plunger into and out of the production tubing of the well. During a cycle, a plunger typically descends through the tubing to the bottom of a well passing through fluids within the well. Once the liquids are above the plunger, these liquids may be picked up or lifted by the plunger and brought to the surface, thus removing most or all liquids in the production tubing. The gas below the plunger will push both the plunger and the liquid on top of the plunger to the surface completing the plunger cycle. In some instances, plunger lift may be combined with gas lift where air/gas is injected into the production tubing to reduce the hydrostatic pressure within the tubing.

SUMMARY

Disclosed herein is a collar stop configured for insertion into well production tubing where the collar stop provides an interference fit with a collar recess disposed between two adjacent sections of production tubing. The collar stop may be utilized to provide a bottom hole assembly at a desired location in a well bore. The collar stop device is configured to lock once positioned. Such locking prevents accidental removal during high fluid flows.

In an arrangement, the collar stop is a generally cylindrical device configured for disposition within production tubing. The collar stop includes a mandrel body and a casing engagement body. The casing engagement body forms a lower portion of the device and incudes an upper end having a central aperture. As used herein, upper and lower define portions of the device as located in a vertical section of production tubing. In an embodiment, the upper end is an annular ring having an internal opening (e.g., central aperture) extending therethrough. At least first and second legs or arms extend (e.g., cantilever) downwardly from generally opposing edges of the upper end (e.g., annular ring). Outside surface of each arm include a casing engagement tab configured for receipt in a collar recess between adjacent section of production tubing. Such engagement tabs are typically located proximate to a free end of each arm.

A mandrel body slidably engages the casing engagement body. In an arrangement, the mandrel body includes upper and lower mandrels connected by an axial rod, which passes through the central aperture in the upper end of the casing engagement body. The lower mandrel is disposed between the arms of the casing engagement body while the upper mandrel is disposed above the upper end of the casing engagement body. The mandrel body is configured to move relative to the casing engagement body between a lower surface of the upper mandrel and an upper surface of the lower mandrel.

A mechanical connector is configured to lock the mandrel body in a lowered or closed position where the upper mandrel is disposed proximate to the upper end of the casing engagement body. In an arrangement, the mechanical connector is a two-piece connector having a first piece (e.g., first connector) attached to an upper portion of the mandrel body and a second piece (e.g., second connector) attached to the upper end of the casing engagement body. When the upper mandrel is disposed (e.g., compressed) towards the upper end of the casing engagement body, the first and second connectors mechanically engage locking the mandrel body in the lowered position. Any mechanical connector may be utilized.

In one aspect, a first connector is attached to the axial rod proximate to a connection point between the upper mandrel and the axial rod. In an arrangement, the first connector is a split ring connector that fits over the axial rod. In such an arrangement, split ring connector has a generally cylindrical body with a hollow interior and a split/slit extending along the entire length of its sidewall. An outside surface of the split ring connector may include a plurality of serrations (e.g., annular ridges and valleys). Such serrations may be configured to engage a plurality of mating grooves (e.g., annular ridges and valleys) formed in the central aperture of the upper end of the casing engagement body. An inside diameter of the split ring connector may have a diameter that is greater than an outside diameter of the axial rod. This increased diameter permits the split ring connector to compress when the serrations engage the grooves in the upper end (e.g., about the periphery of the central aperture) of the casing engagement body. This allows the serrations to pass over at least a portion of the grooves locking the mandrel body to the casing engagement body. The serrations and grooves may be configured to permit unidirectional movement. In a further arrangement, the first connector includes a plurality of serrations integrally formed on an outside surface of the axial rod. In this arrangement, the serrations of the axial rod engage a plurality of grooves formed in the central aperture of the upper end of the casing engagement body. In such an arrangement, a split ring connector may be disposed within the central aperture. Alternatively, the central aperture may include an axial slot to permit the central aperture to flex when engaged by the serrations of the axial rod.

In an arrangement, the split ring connector is attached to the axial rod via a shear pin. Such a shear pin permits separating the axial rod form the split ring connector when an axial force is applied to the upper mandrel (e.g., by a wireline device). This allows removing the collar stop from the production tubing.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1:
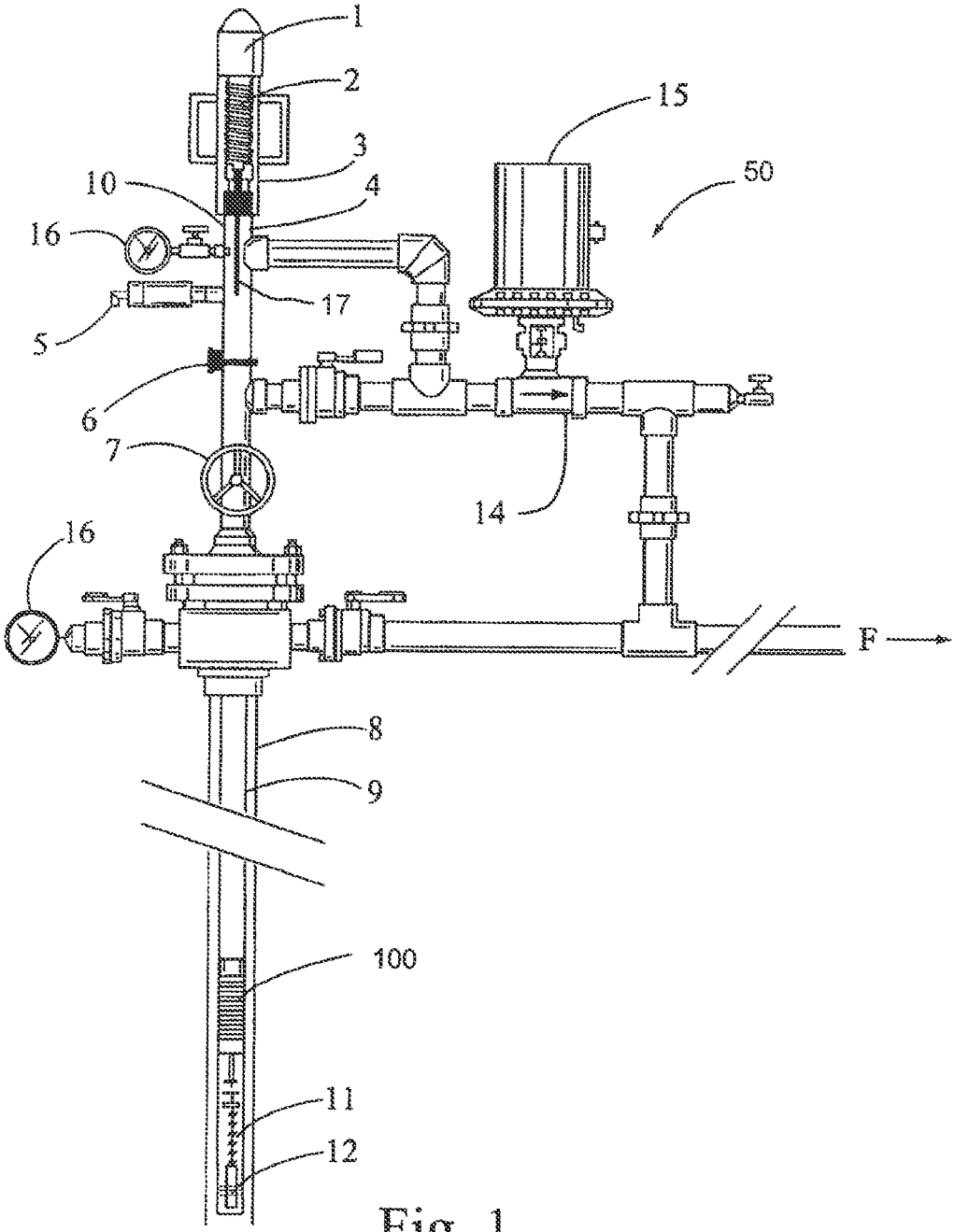
FIG. 1 is a schematic illustration of a production tubing is disposed within a casing of an oil and gas well.

A typical installation plunger lift system 50 can be seen in FIG. 1. The system includes what is termed a lubricator assembly 10 disposed on the surface above a well bore including casing 8 and production tubing 9. The lubricator assembly 10 is operative to receive a plunger 100 from the production tubing 9 and release the plunger 100 into the production tubing 9 to remove fluids (e.g., liquids) from the well. Fluid accumulating above of the plunger 100 at the bottom of the well may be carried to the top of the well by the plunger 100. Specifically, after passing through the liquids at the bottom of the well, gasses accumulate under the plunger lifting the plunger and any fluid above the plunger to the surface. The lubricator assembly 10 controls the cycling of the plunger into and out of the well. The exemplary lubricator assembly 10 includes a cap 1, top bumper spring 2, striking pad 3, and a receiving tube 4, which is aligned with the production tubing. When utilized with a bypass plunger, the lubricator may further include a rod 17 that may extend through a plunger received by the lubricator to open a bypass valve or valve element of the plunger.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate based on time, or pressure, to open or close the surface valves based on operator-determined requirements for production. Alternatively, controllers may fully automate the production process.

In some embodiments, the lubricator assembly 10 contains a plunger auto catching device 5 and/or a plunger sensing device 6. The sensing device 6 sends a signal to surface controller 15 upon plunger 100 arrival at the top of the well and/or dispatch of the plunger 100 into the well. A master valve 7 allows for opening and closing the well. Typically, the master valve 7 has a full bore opening equal to the production tubing 9 size to allow passage of the plunger 100 there through. The bottom of the well is typically equipped with a seating nipple/tubing stop 12. A spring standing valve/bottom hole bumper assembly 11 may also be located near the tubing bottom. The bumper assembly or bumper spring is located above the standing valve and can be manufactured as an integral part of the standing valve or as a separate component.

FIG. 1 illustrates a plunger lift system 50 as installed in a vertical well where a seating nipple is installed at the bottom of the well. In such an arrangement, the plunger cycles between the bottom hole assembly (e.g., seating nipple and spring) and the lubricator assembly. However, in a number of situations, a seating nipple is not installed or is installed at a location that will not work for plunger lift. For instance, lateral wells have a vertical section that extends from the surface and transitions to a horizontal section. Typically, plungers can only fall to about 40-60 degrees from vertical. Nonetheless, such lateral wells can benefit from plunger lift. To permit use of plunger lift in lateral wells or in wells lacking a seating nipple, a temporary/removable bottom assembly or 'collar stop' may be inserted at a desired location within the well (e.g., in a vertical or mostly vertical section of a lateral well). This collar stop may form a bottom hole assembly at a desired location within the well.

Figure 2A:
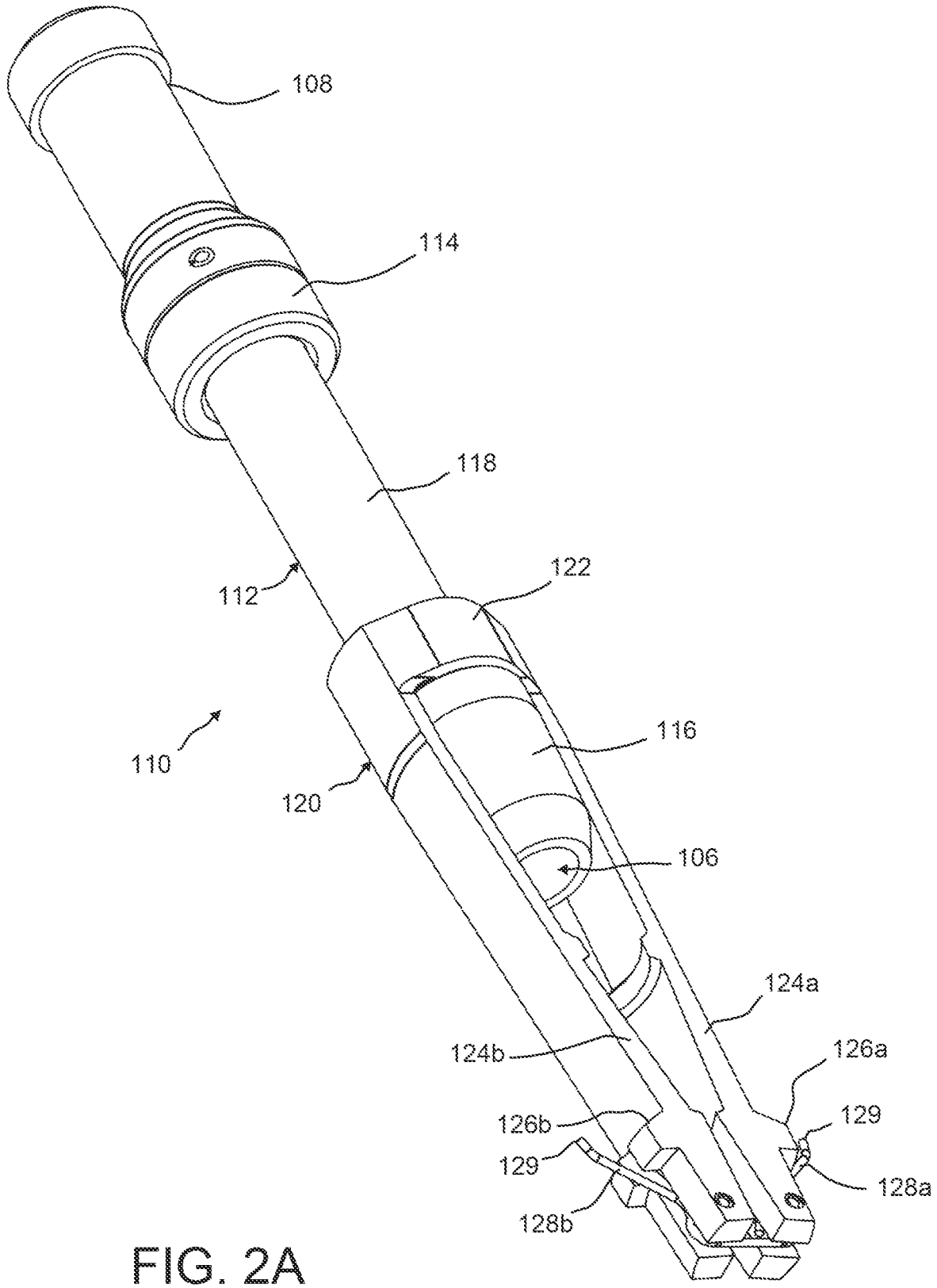
FIG. 2A (Prior Art)
FIG. 2A is a perspective view of a prior art collar stop.
Figure 2B:
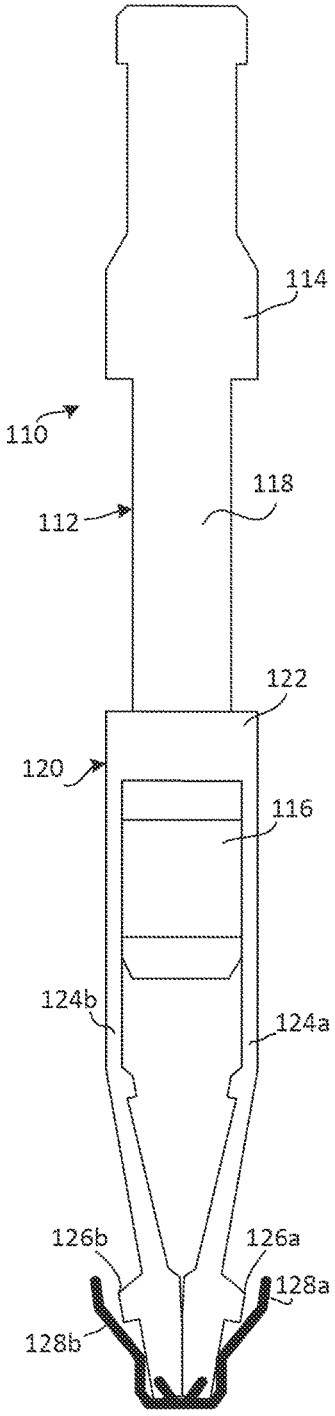
Fig. 2B (Prior Art)
FIGS. 2B-2D illustrate the operation and installation of the collar stop of FIG. 2A.

FIGS. 2A-2D illustrates one embodiment of a prior art collar stop 110. The collar stop 110 is configured for insertion into well production tubing where it provides an interference fit with a collar recess disposed between two adjacent sections of production tubing. As shown in FIG. 2A, the collar stop 110 is a generally cylindrical device having a mandrel body 112 and a casing engagement body 120. The mandrel body includes upper and lower mandrels 114, 116, respectively, connected by an axial rod 118, which is disposed through the casing engagement body 120. The casing engagement body 120 is configured to engage a casing recess to lock the collar stop in production tubing at a desired location, as further described herein.

As shown, the upper mandrel 114 and lower mandrel 116 each have a diameter that is larger than a diameter of the axial rod 118, which passes through (e.g., is slidably received within) an aperture formed in of a top end of the casing engagement body 120. In the illustrated embodiment, the top end of the casing engagement body 120 is a generally annular element having a central aperture, which extends there through, and is referred to herein as an 'annular ring' 122. However, it will be appreciated that the annular ring 122 need not be strictly annular in shape. What is important is that the annular ring 122 forms an upper or top end of the casing engagement body and includes an aperture (e.g., central aperture) for slidably receiving the axial rod 118 of the mandrel body 112. Diameters of the upper mandrel 114 and lower mandrel 116 are larger than the diameter of the central aperture extending through the annular ring 122. Accordingly, once the axial rod 118 is disposed through the central aperture of the annular ring 120, the mandrel body 112 may slide through the annular ring 120 between a bottom end 115 of the upper mandrel 114 and an upper end 117 of the lower mandrel 116. That is, the mandrel body 112 moves relative to the casing engagement body 120.

Figure 2C:
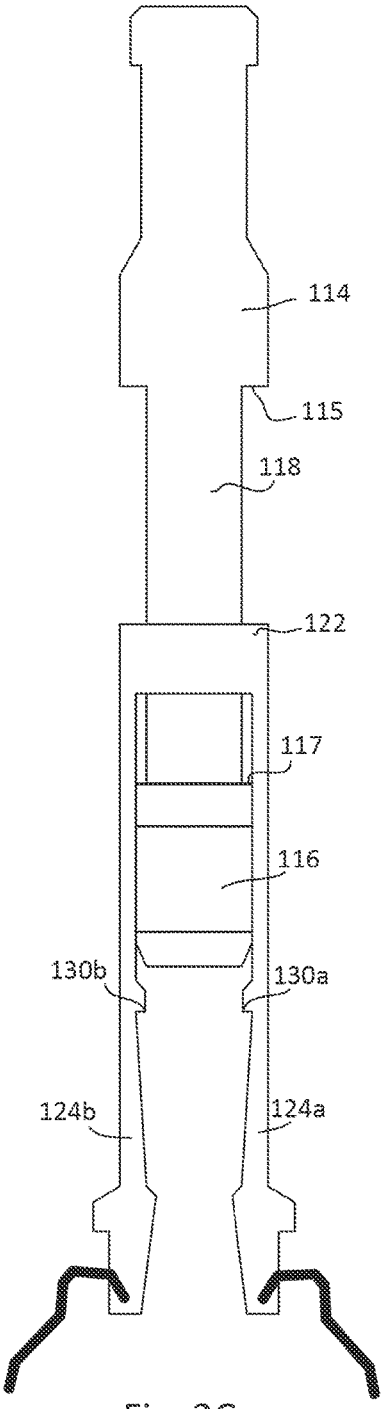
Fig. 2C (Prior Art)

The casing engagement body 120 further includes first and second legs or arms 124*a*, 124*b* (hereafter 124 unless specifically referenced) that extend from a lower end of the annular ring 122. That is, the arms 124 cantilever from the lower end of the annular ring 122. The lower mandrel 116 is disposed between the inside surfaces of the arms 124. Disposed proximate to the free end of each of the arms 124 on their outside surfaces are casing engagement tabs 126*a*, 126*b* (hereafter 126 unless specifically referenced). Also attached to lower end of each arm 124 are tripwires 128*a*, 128*b* (hereafter 128 unless specifically referenced). The tripwires 128 are configured to hold the arms 124 toward one another when the arms are deflected to permit inserting the collar stop 110 into production tubing. More specifically, the tripwires are pivotally attached near the free ends of the arms 124 and configured to hold the free ends of the arms 124 toward one another (See FIGS. 2A and 2B), in a first position, and release the free ends of the arms 124 (See. FIG. 2C), in a second position.

When the tripwires 128 hold the free ends of the arms 124 together, an outward diameter measured between opposing outside surfaces of the casing engagement tabs 126 is reduced to a dimension that is less than an inside diameter of production tubing in which the collar stop 110 is inserted. This allows lowering the collar stop 110 downward through production tubing. Along these lines, the upper mandrel 114 may include a fishing neck 108, which may comprise a standard American Petroleum Institute (API) fishing neck. The fishing neck 108 may be engaged by a wireline device (not shown), as known by those skilled in the art. The wireline lowers the collar stop through the production tubing to a desired location while the tripwires 128 hold the free ends of the arms 124 toward one another/together. Once lowered to a desired depth, the wireline raises the collar stop 110 until free ends 129 of the tripwires 128 engage a collar recess between adjacent joints of production tubing. That is, when pulled upward, the tripwires snag on a collar recess 140 formed by a collar 144 connecting adjacent sections of production tubing 146. See, e.g., FIG. 2D. This releases the tripwires freeing the arms 124, which expand outward. The collar stop 110 may then be raised or lowered until the casing engagement tabs 126 encounter the collar recess 140. See FIG. 2D. The cantilevered arms 124 press the engagement tabs 126 into the recess 140.

Once the engagement tabs 126 are engaged with the collar recess 140, the mandrel body 112 is pushed downward until the lower mandrel 116 is positioned between lower portions of the arms 124, which prevents the arms from flexing inward. See FIG. 2D. This locks the casing engagement tabs 126 in the collar recess 140. To maintain the mandrel body 112 in the lowered position (See FIG. 2D), the lower mandrel 116 is pushed downward until its upper end 117 is disposed below locking tabs 130*a*, 130*b* formed in the inside surfaces of the arms 124. This engagement helps maintain the mandrel body 112 in the lowered position and maintains the collar stop 110 in place. Once secured in position, the upper end of the collar stop 110, may then support other components (e.g., bumper springs etc.). Such components may engage the fishing neck to secure them to the collar stop 110. Of further note, the mandrel body 112 includes an axial passageway 106 that permits well fluids to pass through the collar stop 110, when secured within the production tubing.

The collar stop 110 may be removed by engaging the fishing neck 108 and lifting the mandrel body 112. This removes the lower mandrel 116 from behind the arms 124 permitting the arms 124 to flex such that the engagement tabs 126 may move inward and out of the collar recess 140 disengaging the collar stop 110 from the collar recess. The collar stop may then be lifted to the surface.

Aspects of the present disclosure are based on the realization that in certain wells with high flow rates, the flow of fluids through the axial passageway 106 of the mandrel body 112 tends to dislodge or lift the mandrel body 112 from the lowered position. That is, such high fluid flows move the mandrel body 112 upward releasing the engagement tabs 126 of the casing engagement body 120. In such situations, high fluid flows lift the collar stop 110 to the surface. To counteract such high flow conditions, the presented collar stop utilizes a locking connector which locks the axial rod 118 of the mandrel body 112 to the annular ring 122 of the casing engagement body 120 when the mandrel body is in the lowered position.

Figure 2D:
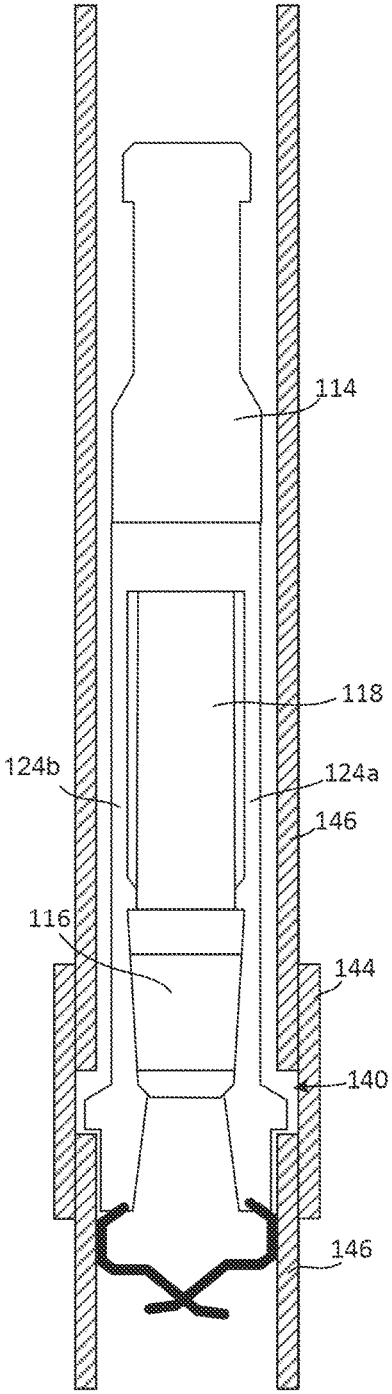
Fig. 2D (Prior Art)
Figure 3A:
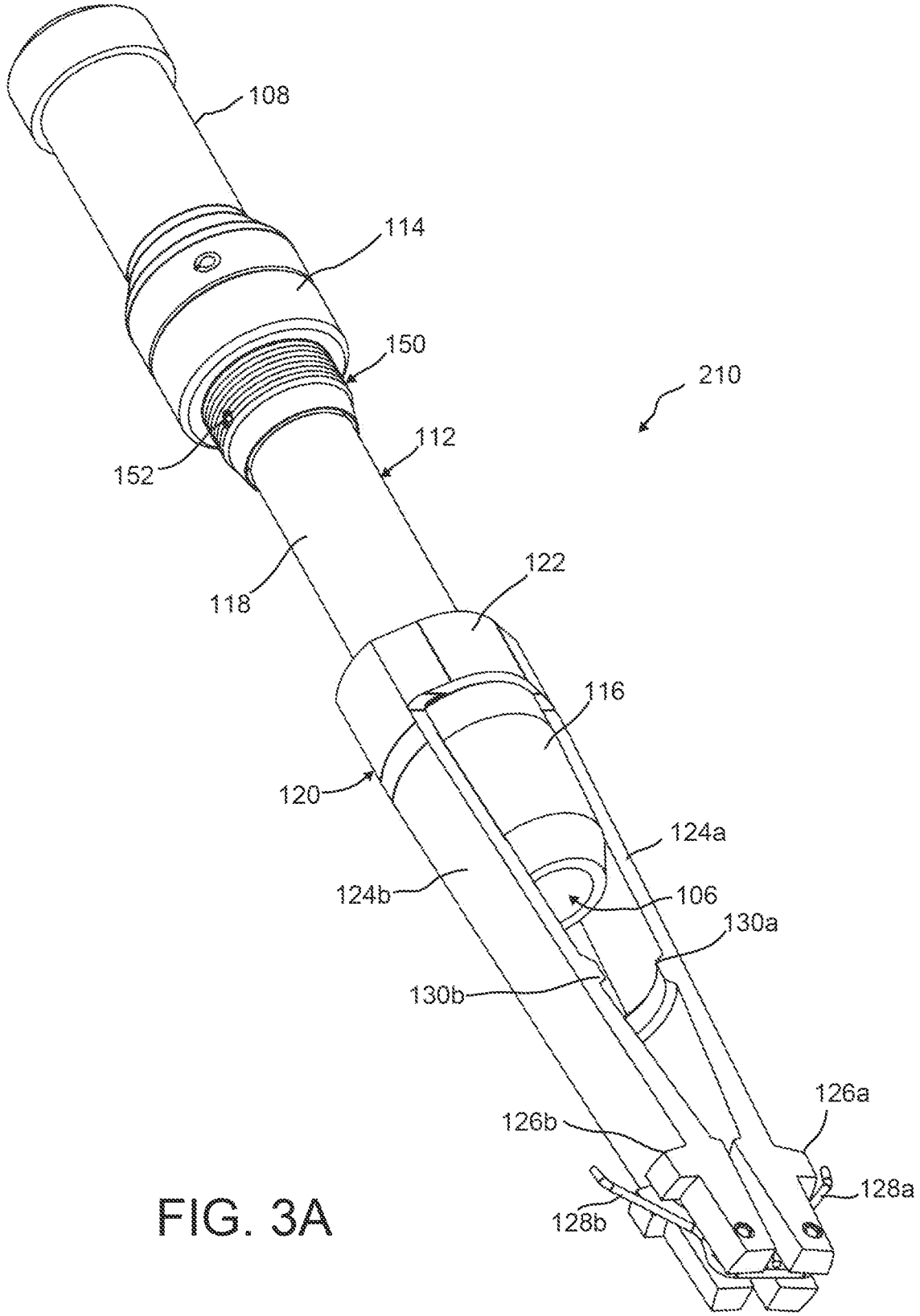
FIG. 3A is a perspective view of a locking collar stop in accordance with the present disclosure.
Figure 3B:
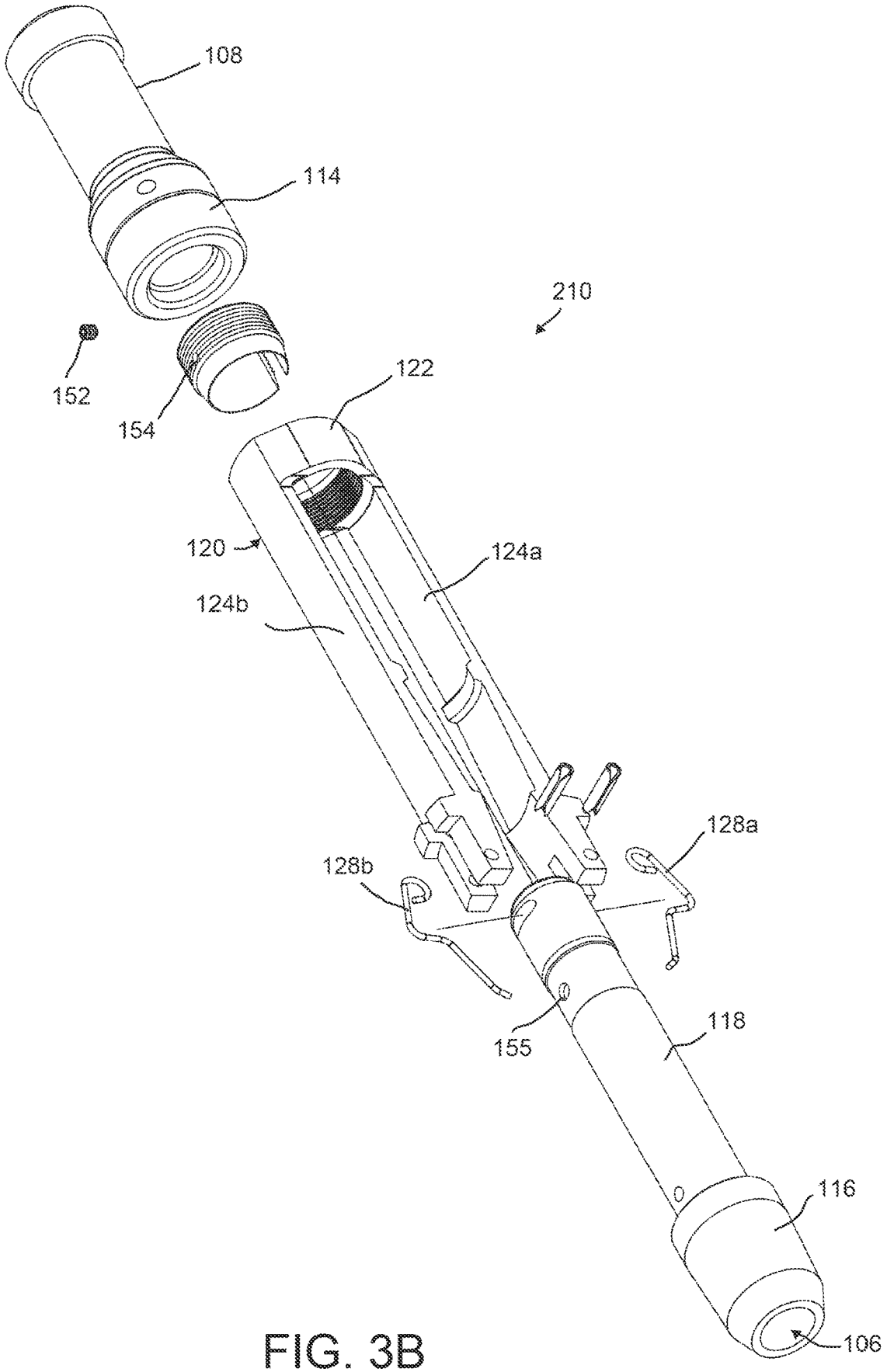
FIG. 3B is an exploded view of the collar stop of FIG. 3A.

FIGS. 3A and 3B illustrate one embodiment of a locking collar stop 210 in accordance with the present disclosure. As illustrated, the locking collar stop 210 shares numerous component as the prior art collar stop described in relation to FIGS. 2A-2D and common reference numbers are utilized to refer to common components. The locking collar stop 210 incudes a mandrel body 112 that moves relative to a casing engagement body 120. More specifically the mandrel body 112 includes upper and lower mandrels 114, 116 connected by an axial rod 118 while the casing engagement body 120 incudes an annular ring 122 having first and second arms 124*a*, 124*b* (hereafter 124 unless specifically referenced) that cantilever from a lower end of the annular ring 122. The axial rod 118 passes through the annular ring permitting the mandrel body 112 to move relative to the casing engagement body 120. Likewise, the arms 124 each include casing engagement tabs 126*a*, 126*b* (hereafter 126 unless specifically referenced) on their outside surfaces disposed near their free ends. Tripwires 128*a*, 128*b* (hereafter 128, specifically referenced) are also attached near the free ends of the arms for use in deflecting and holding the arms 124 toward one another as illustrated in FIG. 3A. The arms also include locking tabs 130*a*, 130*b* formed their inside surfaces for engaging the upper end of the lower mandrel 116 when the mandrel body 112 is in the lowered position. The locking collar stop 210 is inserted into production tubing in a manner that is substantially similar to the process described in relation to FIGS. 2B-2D.

As best shown in FIGS. 3A-4B, the locking collar stop 210 further incorporates a locking connector which mechanically engages (e.g., locks) the axial rod 118 of the mandrel body 112 to the annular ring 122 of the casing engagement body 120, when the mandrel body 112 is in the closed position. In the illustrated embodiment, the locking connector is a two-piece connector having a first connector attached to the mandrel body 112 and a second connector (e.g., mating connector) attached to the casing engagement body 120. In the illustrated embodiment, the first connector is split ring connector 150 that is disposed about the axial rod 118 proximate to the point of connection between the axial rod 118 and the upper mandrel 114. As illustrated, the split ring connector 150 is attached to the axial rod 118 via a shear pin 152 that passes through an aperture 154 in a sidewall of the split ring connector 150 and extends into a mating aperture 155 in the axial rod 118. See FIG. 3B. In the illustrated embodiment, the second connector is formed within the central aperture of the annular ring 122, as more fully discussed herein.

Figure 5:
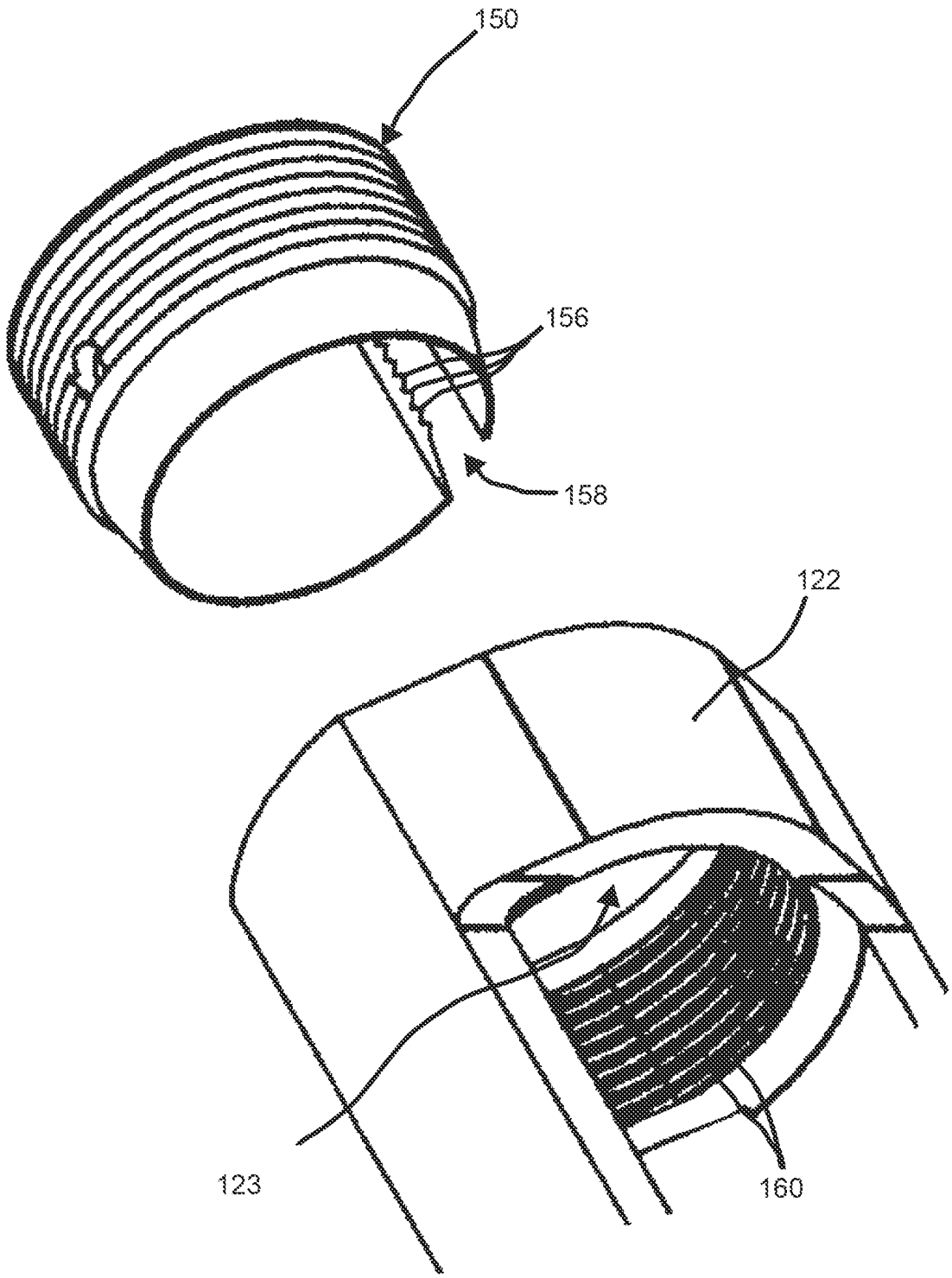
FIG. 5 shows a perspective view of a two-piece connector for locking the collar stop in a closed position.

FIG. 5 shows a close up view of the split ring connector 150 and the mating connector 160 formed within the central aperture 124 of the annular ring. As shown, the split ring connector 150 is a generally cylindrical and hollow element having a sidewall sized to fit over/around an outside surface of the axial rod. The outside surface of the sidewall of the connector 150 has a series of serrations (e.g., annular grooves) 156. This serrated outside surface (e.g., sawtooth surface) of the split ring connector 150 is configured for receipt within mating serrations 160 (e.g., second connector) formed in the interior surface of the annular ring 122. That is, the inside peripheral surface of the central aperture 123 includes serrations/grooves 160 that are configured to mate with the serrations 156 on the outside surface of the split ring connector 150. Of note, the inside diameter 'ID' of the connector 150 is slightly larger than the outside diameter 'OD' of the axial rod such that the split ring connector 150 may compress slightly. See, e.g., FIG. 6. That is, a split 158 extending along the entire length of a sidewall of the connector 150 allows for slightly compressing the connector 150 around the axial rod. Accordingly, when the connector 150 is forced into the central aperture 123 of the annular ring 122, the split ring connector 150 may compress such that the serrations 156 on its outside surface may pass over the serrations 160 formed on the inside surface of the annular ring 122.

Figure 4A:
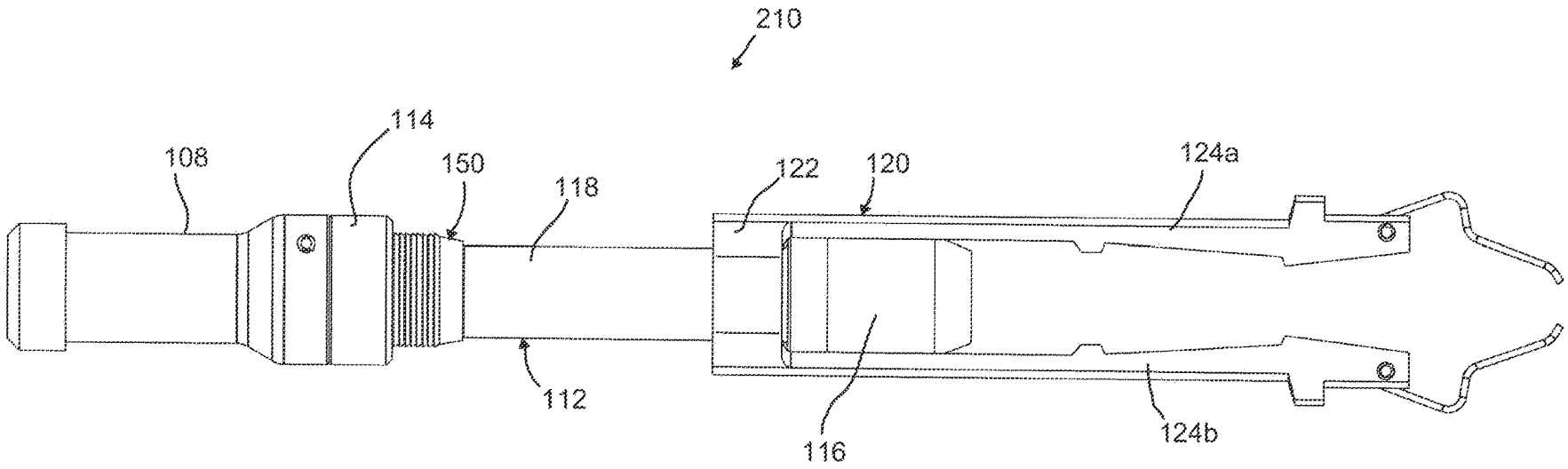
FIGS. 4A and 4B show side and side cross-sectional views, respectively, of a collar stop in an open position.
Figure 4B:
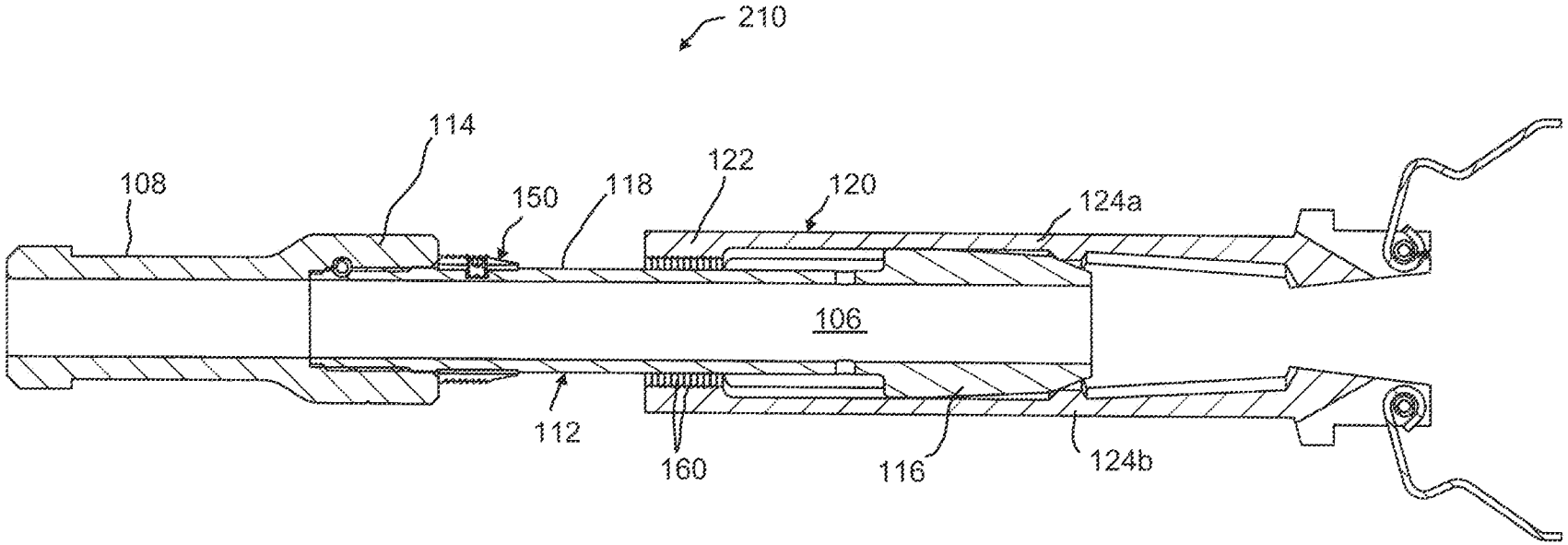
Figure 4C:
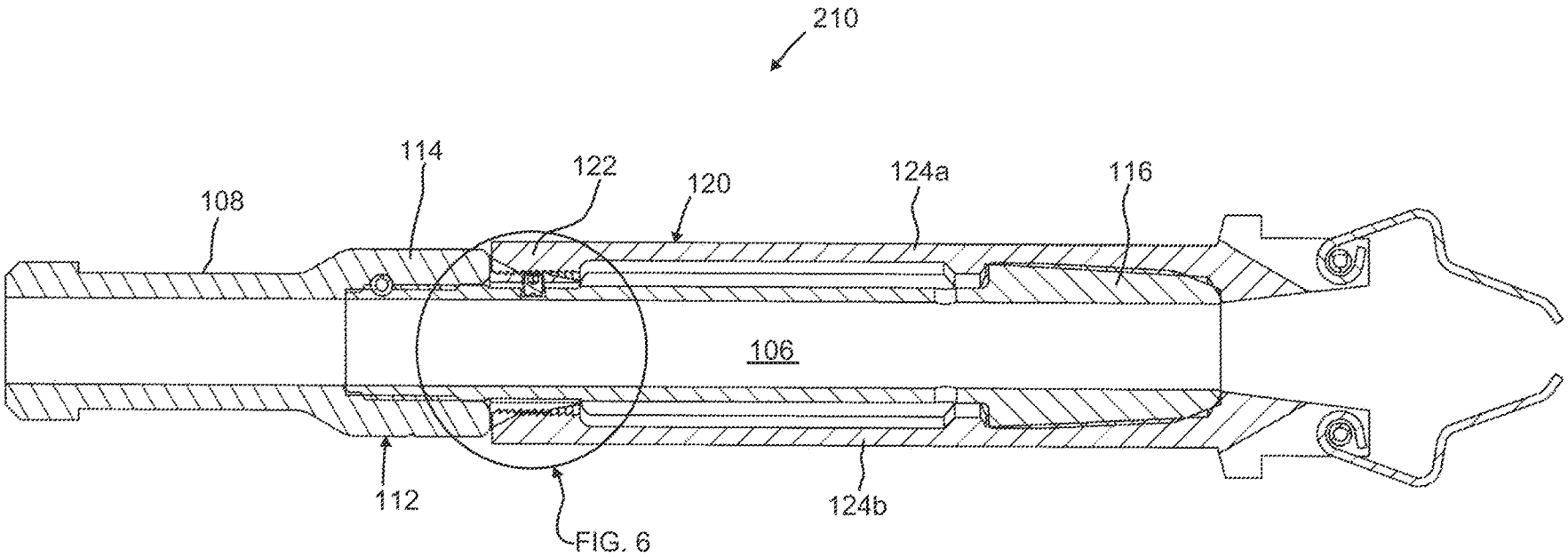
FIG. 4C shows a side cross-sectional view of a collar stop in a closed and locked position.
Figure 6:
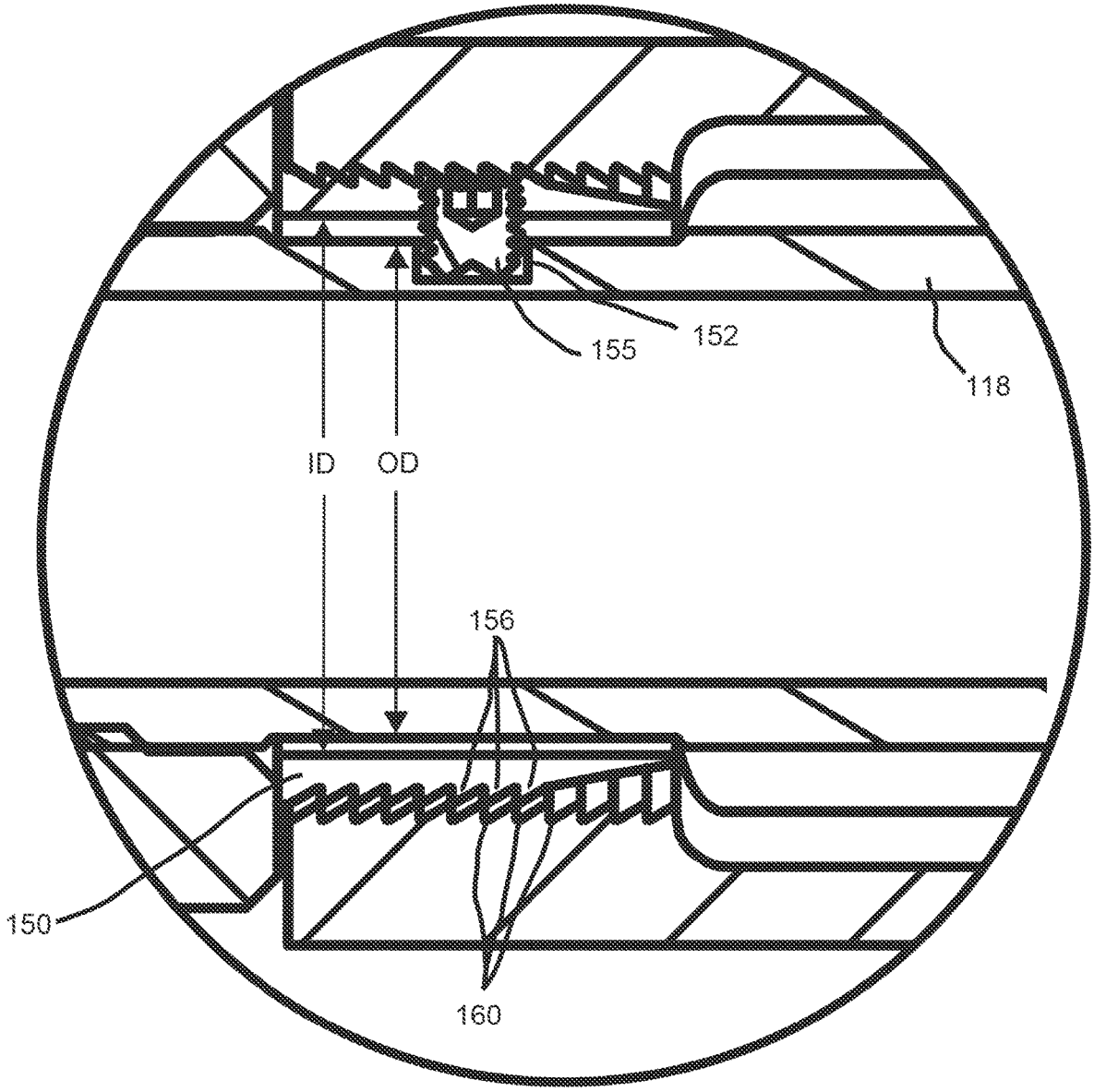
FIG. 6 shows a close up view of the two-piece connector locking the collar stop in the closed position.

FIGS. 4A-4C illustrate the locking collar stop 210 in open and locked configurations. More specifically, FIGS. 4A and 4B illustrates a side view and a cross-sectional side view, respectively, of the collar stop 210 in an open configuration while FIG. 4C illustrates a cross-sectional side view of the collar stop in a closed and locked configuration. As illustrated, when the mandrel body 112 moves from the open configuration (e.g., FIG. 4B) to the closed configuration (e.g., FIG. 4C) the split ring connector 150 is forced into the central aperture of the annular ring 120 such that the serrations 156 of the connector 150 mate with the serrations 160 of the annular ring 122. This is best illustrated in FIG. 6, which shows a close up of the engagement of the split ring connector 150 and the annular ring 122. As shown in FIG. 6, the serrations 156 and 160 may be shaped to permit unidirectional movement of the split ring connector 150 into the annular ring 122. Once the serrated surfaces are engaged, the mandrel body 112 is locked in the lowered/closed position.

In application, the locking collar stop 210 is positioned in production tubing such that the collar engagement tabs are disposed within a collar recess (See, e.g., FIG. 2D). Once the engagement tabs are engaged with the collar recess, the mandrel body 112 is pushed downward until the lower mandrel 116 is positioned between a lower portion of the arms 124, which prevents the arms from flexing inward. The force(s) applied to the mandrel body 112 also forces the split ring connector 150 into the aperture of the annular ring 122 locking the collar stop 210 in place. Once locked, the collar stop is able to withstand high fluid flow passing through its axial passageway 106 that tend to dislodge the prior art collar stops.

Once the locking collar stop is locked with the split connector engaged with the annular ring, the locking collar stop 210 is highly resistant to removal. However, most collar stops are designed for periodic removal from production tubing. To allow removal of the locking collar stop 210, the split ring connector is attached to the axial rod via the shear pin 152 (e.g., set screw) that passes through an aperture in a sidewall of the split ring connector 150 and extends into a mating aperture 156 in the axial rod 118. See. FIG. 6. The shear pin 152 is typically formed of a material having a hardness and shear strength that is significantly less that the hardness and shear strength of the axial rod 118 and split ring connector 150. In a non-limiting embodiment, the shear pin may be formed from brass while the axial rod and split ring connector are formed of steel (e.g., stainless steel). Other materials are possible. To remove the locking collar stop 210, a wireline attaches to the fishing neck and applies an upward force to the mandrel body. This upward force shears the shear pin freeing the axial rod 118 from the split ring connector 150. The mandrel body 112 may then be moved upward removing the lower mandrel 116 from behind the arms 124 permitting the arms 124 to flex such that the engagement tabs 126 may move inward out of the collar recess 140 and thereby allowing the locking collar stop 210 to be lifted to the surface.

Figure 7:
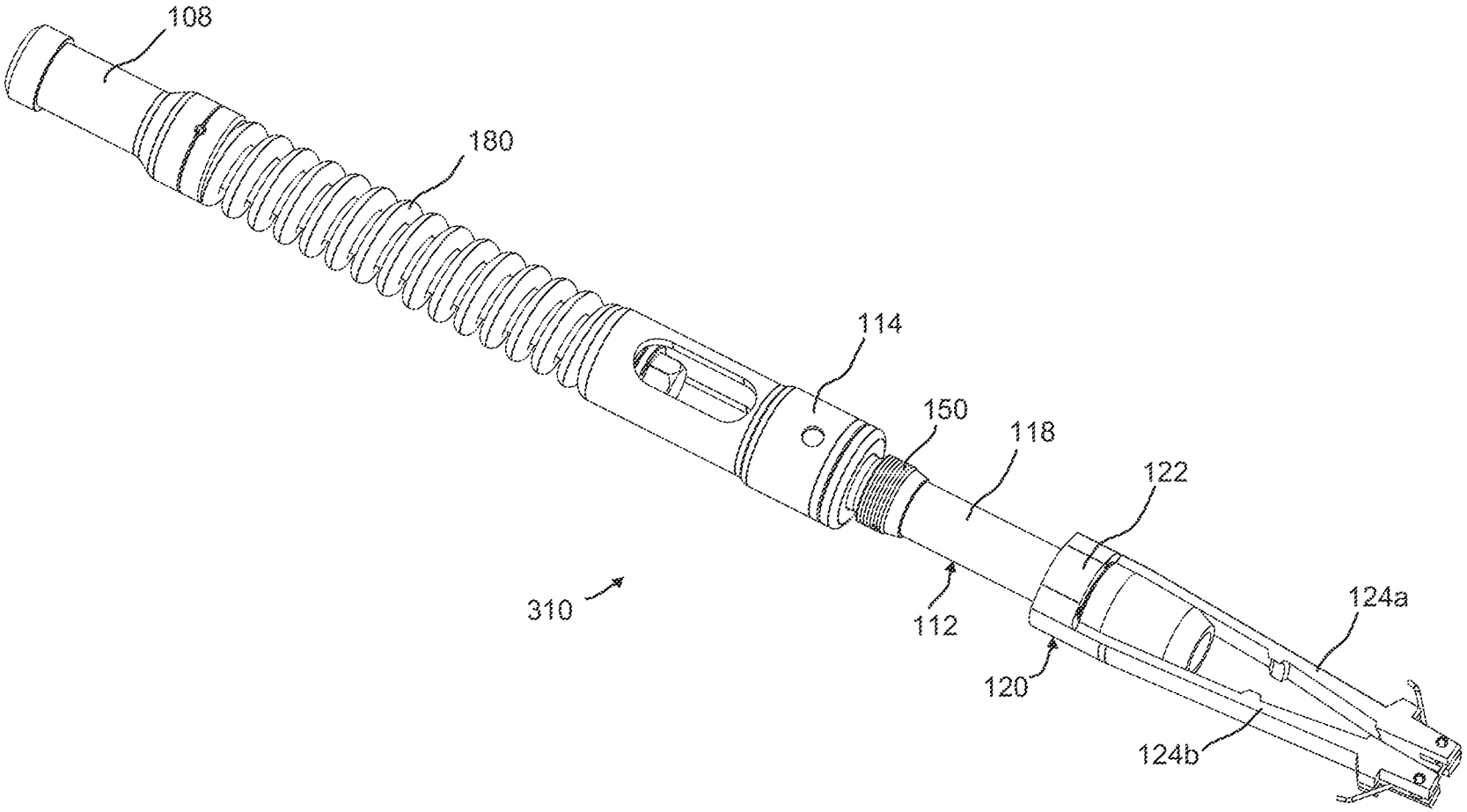
FIG. 7 illustrates an alternate embodiment of a locking collar stop in accordance with the present disclosure.

FIG. 7 illustrate another embodiment of a locking collar stop 310 in accordance with the present disclosure. As illustrated, the locking collar stop 310 shares numerous component as the prior art collar stop described in relation to FIGS. 3A-6 and common reference numbers are utilized to refer to common components. The locking collar stop 310 incudes a mandrel body 112 that moves relative to a casing engagement body 120. More specifically the mandrel body 112 includes upper and lower mandrels 114, 116 connected by an axial rod 118 while the casing engagement body 120 includes an annular ring 122 having first and second arms 124*a*, 124*b* (hereafter 124 unless specifically referenced) that cantilever from a lower end of the annular ring 122. The axial rod 118 passes through the annular ring permitting the mandrel body 112 to move relative to the casing engagement body 120. Likewise, the arms 124 each include casing engagement tabs 126*a*, 126*b* (hereafter 126 unless specifically referenced) on their outside surfaces disposed near their free ends. The locking collar stop 310 is inserted into and removed from production tubing as described above.

As illustrated, in the embodiment of FIG. 7, the upper mandrel 114 further includes a bumper spring 180. That is, as opposed to the upper mandrel 114 terminating in a fishing neck 108, the upper mandrel may further include one or more components, such as the bumper spring 180. In such an embodiment, rather than placing the locking collar stop within production tubing and then utilizing the fishing neck of the locking collar stop to attach one or more components to the locking collar stop, such components may be placed within the production tubing with the collar stop. These components may be integrally formed or otherwise connected to the collar stop. Further, it will be appreciated that various different components may be attached to the upper mandrel.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A locking collar stop device, comprising:

a casing engagement body having an upper end with a central aperture and first and second arms that cantilever downward from opposing sides of the upper end, each arm having a casing engagement tab formed on an outside surface proximate to a free end of the arm;

a mandrel body having an upper mandrel, a lower mandrel and an axial rod extending between and connecting the upper mandrel and the lower mandrel, wherein the lower mandrel is disposed between inside surfaces of the first and second arms, the axial rod is slidably received through the central aperture and the upper mandrel is disposed above the upper end of the casing engagement body;

a first connector disposed on the mandrel body proximate to a point of connection between the upper mandrel and the axial rod;

a second connector disposed on the upper end of the casing engagement body; wherein the first and second connector mechanically connect when the upper mandrel is compressed against the upper end of the casing engagement body locking the upper mandrel relative to the casing engagement body; and a shear pin that connects one of the first connector to the mandrel body or the second connector to the casing engagement body, wherein the shear pin is configured to shear upon the upper mandrel moving away from the upper end of the casing engagement body after the first connector and the second connector mechanically connect.

2. The device of claim 1, wherein the mandrel body is configured to move relative to the casing engagement body between a lower surface of the upper mandrel and an upper surface of the lower mandrel.

3. The device of claim 2, wherein the first connector comprises:

a split ring connector disposed about an outside surface of the axial rod.

4. The device of claim 3, wherein the split ring connector comprises:

a cylindrical body having:

a generally cylindrical sidewall;

a plurality of serration formed about an outside surface of the sidewall; and an axial split extending along an entire length of the sidewall.

5. The device of claim 4, wherein the second connector comprises:

a plurality of grooves formed on an inside peripheral surface of the central aperture, wherein the serrations of the split ring connector are sized to engage the grooves of the central aperture.

6. The device of claim 4, wherein an inside diameter of the split ring connector is greater than an outside diameter of the axial rod.

7. The device of claim 4, wherein the shear pin connects the spilt ring connector to the axial rod, wherein the shear pin has a hardness that is less than a hardness of the axial rod and less than a hardness of the split ring connector.

8. The device of claim 2, wherein the upper mandrel further comprises:

a fishing neck.

9. The device of claim 2, wherein each arm further comprises:

a tripwire pivotally attached proximate to the free end of the arm.

10. The device of claim 1, wherein each arm further comprises:

a locking tab formed on an inside surface along the length of the arm, wherein the locking tab engages an upper edge of the lower mandrel when the upper mandrel is compressed against the upper end of the casing engagement body.

11. A locking collar stop device, comprising:

a casing engagement body having:

an annular ring with a central aperture extending through the annular ring, an inner periphery of the central aperture having a plurality of grooves;

first and second arms that cantilever downward from opposing sides of the annular ring, each arm having a casing engagement tab formed on an outside surface proximate to a free end of the arm;

a mandrel body having:

an upper mandrel;

a lower mandrel;

an axial rod extending between and connecting the upper mandrel and the lower mandrel, wherein the lower mandrel is disposed between inside surfaces of the first and second arms, the axial rod is slidably received through the central aperture and the upper mandrel is disposed above an upper end of the casing engagement body;

a split ring connector disposed about an outside surface of the axial rod proximate to a point of connection between the upper mandrel and the axial rod, the split ring connector having serrations disposed about an outside surface, wherein the serrations mechanically engage at least a portion of the plurality of grooves of the central aperture when the upper mandrel is compressed against the annular ring locking the upper mandrel relative to the casing engagement body; and a shear pin that connects the split ring connector to the axial rod, wherein the shear pin is configured to shear upon the upper mandrel being withdrawn from the annular ring after the serrations have mechanically engaged the plurality of grooves.

12. The device of claim 11, wherein the split ring connector comprises:

a cylindrical body having:

a generally cylindrical sidewall, wherein the serrations are formed about an outside surface of the sidewall; and an axial split extending along an entire length of the sidewall.

13. The device of claim 12, wherein an inside diameter of the split ring connector is greater than an outside diameter of the axial rod.

14. The device of claim 11, wherein the shear pin has a hardness that is less than a hardness of the axial rod and less than a hardness of the split ring connector.

15. The device of claim 11, wherein each arm further comprises:

a locking tab formed on an inside surface along the length of the arm, wherein the locking tab engages an upper edge of the lower mandrel when the upper mandrel is compressed against the annular ring.

* * * * *